US007918970B2

(12) United States Patent
Bez

(10) Patent No.: US 7,918,970 B2
(45) Date of Patent: Apr. 5, 2011

(54) BAND FOR A MACHINE FOR PRODUCING WEB MATERIAL, IN PARTICULAR PAPER, BOARD OR TISSUE, AND PROCESS FOR THE PRODUCTION OF SUCH A BAND

(75) Inventor: Frank Bez, Sonnenbühl (DE)

(73) Assignee: Voith Patent GmbH, Heidenheim (DE)

( * ) Notice: Subject to any disclaimer, the term of this patent is extended or adjusted under 35 U.S.C. 154(b) by 713 days.

(21) Appl. No.: 11/850,975

(22) Filed: Sep. 6, 2007

(65) Prior Publication Data

US 2008/0064281 A1 Mar. 13, 2008

(30) Foreign Application Priority Data

Sep. 8, 2006 (DE) ..... 10 2006 042 812

(51) Int. Cl.
*D21F 7/08* (2006.01)
*D21F 7/10* (2006.01)
*D21F 7/12* (2006.01)
*D03D 3/04* (2006.01)

(52) U.S. Cl. ..... 162/358.2; 162/900; 162/902; 162/904; 428/58; 28/141; 139/383 AA

(58) Field of Classification Search ..... 162/348, 162/358.2, 900, 902–904; 428/58; 139/383 AA; 245/10; 28/141
See application file for complete search history.

(56) References Cited

U.S. PATENT DOCUMENTS

| | | | | |
|---|---|---|---|---|
| 3,109,219 | A * | 11/1963 | De Bell et al. | 162/348 |
| 3,335,986 | A * | 8/1967 | Cross | 245/10 |
| 3,366,355 | A | 1/1968 | Haller | 245/10 |
| 4,311,172 | A * | 1/1982 | Eckstein | 139/383 AA |
| 4,658,863 | A * | 4/1987 | Errecart | 139/383 AA |
| 5,405,669 | A * | 4/1995 | Lidar | 428/58 |
| 6,875,315 | B2 * | 4/2005 | Bakken et al. | 162/348 |
| 7,005,038 | B2 * | 2/2006 | Maguire | 162/348 |
| 2009/0056900 | A1 * | 3/2009 | O'Connor et al. | 162/358.2 |

FOREIGN PATENT DOCUMENTS

| | | |
|---|---|---|
| DE | 615628 | 8/1932 |

* cited by examiner

*Primary Examiner* — Eric Hug
(74) *Attorney, Agent, or Firm* — Taylor IP

(57) ABSTRACT

A band for a machine for producing web material, in particular paper, board or tissue, includes at least one fabric layer having longitudinal filaments running substantially in a band longitudinal direction and transverse filaments running substantially in a band transverse direction, end regions of the longitudinal filaments being woven with transverse connecting filaments in order to provide an endless configuration of the band, cross-sectional widenings being provided at the filament ends of at least some of the longitudinal filaments woven with transverse connecting filaments.

12 Claims, 1 Drawing Sheet

BAND FOR A MACHINE FOR PRODUCING WEB MATERIAL, IN PARTICULAR PAPER, BOARD OR TISSUE, AND PROCESS FOR THE PRODUCTION OF SUCH A BAND

BACKGROUND OF THE INVENTION

1. Field of the Invention

The present invention relates to a band for a machine for producing web material, such as paper, board or tissue, and to a process for the production of such a band.

2. Description of the Related Art

In machines for producing web material, which is to say for example paper, board or tissue machines, bands which are permeable to air or steam for the extraction of moisture from the web material to be produced are used in various sections. Such bands, to be used in press sections or drying sections, for example, are frequently provided as woven bands in order to provide this necessary permeability, having longitudinal filaments running in a band longitudinal direction and transverse filaments running in a band transverse direction, the band longitudinal direction generally also corresponding to the direction of movement of the band. In order to be able to provide the bands in an endless configuration necessary for such machines, it is possible for example to provide the longitudinal ends of a band element produced in a weaving operation with projecting end regions, which is to say end regions not woven with weft filaments of the body of the band. These end regions of the longitudinal filaments projecting at the two ends of the body of the band are then woven with connecting transverse filaments in a connecting operation, so that a connecting zone is formed in which, although in principle a woven structure corresponding to the woven structure of the remaining body of the band with a corresponding bonding pattern is present, the ends of longitudinal filaments woven with the transverse connecting filaments still project. The filament ends are then shortened, so that they do not project substantially beyond the surface of the woven structure.

It has been shown that, primarily in the edge regions of such bands, there is the risk that the ends of the filaments shortened in this way will slip out of the fabric interspaces formed by the longitudinal and transverse filaments surrounding the ends of the filaments, so that frayed strips arise which have a visual appearance which corresponds to that of a ladder. The fact that this problem occurs primarily in the edge regions of such a band, which is to say those regions which do not come into contact with the web material to be produced, could point to the fact that this problem is thermally induced since, in these regions, cooling of the band heated in the production process by the web material to be transported onward is not produced. In addition, the action of cleaning liquid discharged from cleaning nozzles at comparatively high pressure could promote this slipping out of the ends of the filaments.

What is needed in the art is a band for a machine for producing web material, in particular paper, board or tissue, in which the problem of the filament ends slipping out is eliminated. Furthermore, a process for the production of such a band for producing web material is needed.

SUMMARY OF THE INVENTION

The present invention provides a band for a machine for producing web material, in particular paper, board or tissue, including at least one fabric layer having longitudinal filaments running substantially in a band longitudinal direction and transverse filaments running substantially in a band transverse direction, end regions of the longitudinal filaments being woven with transverse connecting filaments in order to provide an endless configuration of the band, cross-sectional widenings being provided at the filament ends of at least some of the longitudinal filaments woven with transverse connecting filaments.

Since cross-sectional widenings are formed at the ends of the longitudinal filaments in the band according to the invention, the risk of these filament ends slipping out from the fabric interspaces or fabric meshes, formed by the longitudinal and transverse filaments surrounding their respective filament end, is virtually eliminated.

In this case, for example, provision can be made for the cross-sectional widenings to form an integral constituent part of the longitudinal filaments. In this way, the fitting of additional materials, such as adhesive or the like, can be dispensed with. This is advantageous in particular since it is not necessary to pay attention to the requisite compatibility of the structural material of the longitudinal filaments with additional material, such as adhesives.

For instance, at least some of the cross-sectional widenings can be formed by knotting the filament ends.

In an alternative way of providing the cross-sectional widenings, it is proposed that at least some of the cross-sectional widenings be formed by deforming the filament ends. For this purpose, it has proven to be particularly advantageous for at least some of the longitudinal filaments provided with cross-sectional widenings to be constructed from thermoplastic material and for the cross-sectional widenings to be formed by hot deformation.

In a further alternative variant, provision can be made for at least some of the cross-sectional widenings to be formed by fitting clamping elements to the filament ends. This variant is advantageous in particular when, because of the dimensioning or of the material of the longitudinal filaments, knotting the filament ends or deforming the filament ends, for example by way of thermal action, is not possible.

Above all when the problem of the filament ends slipping out is primarily to be expected in edge regions of such a band, it is advantageous if longitudinal filaments are provided with cross-sectional widening substantially only in edge regions of the band. In this way, in that region of the width of the band in which this problem is not to be expected, it is possible to dispense with the performance of processing measures for providing the cross-sectional widenings, and, furthermore, it is possible to eliminate the risk that projections possibly formed by cross-sectional widenings will generate marking effects in the web material to be produced.

In order to be able to reliably prevent the filament ends slipping out, it is proposed that the cross-sectional widenings at the filament ends be dimensioned in such a way that they are larger than the fabric interspaces produced in the region of such filament ends by filaments surrounding the latter.

Because of the dimensioning of such bands for machines for producing web material, it is particularly advantageous if the longitudinal filaments are warp filaments and the transverse filaments are weft filaments. Thus, bands of this type can be produced virtually with any desired length with a predefined band width.

As already explained at the beginning, it is possible to use bands of this type in various regions of machines for producing web material, which is to say for example paper, board or tissue machines. For instance, a band of this type can be provided for use in a press section. It is also possible to provide a band of this type for use in a drying section.

According to another aspect of the present invention, a process for the production of a band for a machine for producing web material, in particular paper, board or tissue, is provided. The process includes the following measures:

a) producing a band body including at least one fabric layer having longitudinal filaments running substantially in a band longitudinal direction and transverse filaments running substantially in a band transverse direction in such a way that, at band body ends, the longitudinal filaments project with end regions;
b) weaving the end regions of the longitudinal filaments at the band body ends with transverse connecting filaments in order to provide an endless configuration of the band; and
c) providing cross-sectional widenings at filament ends of at least some of the longitudinal filaments.

In this process, provision can also be made that, after the measure (b) has been carried out and before the measure (c) is carried out, the filament ends of the longitudinal filaments are shortened to a predetermined excess dimension.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
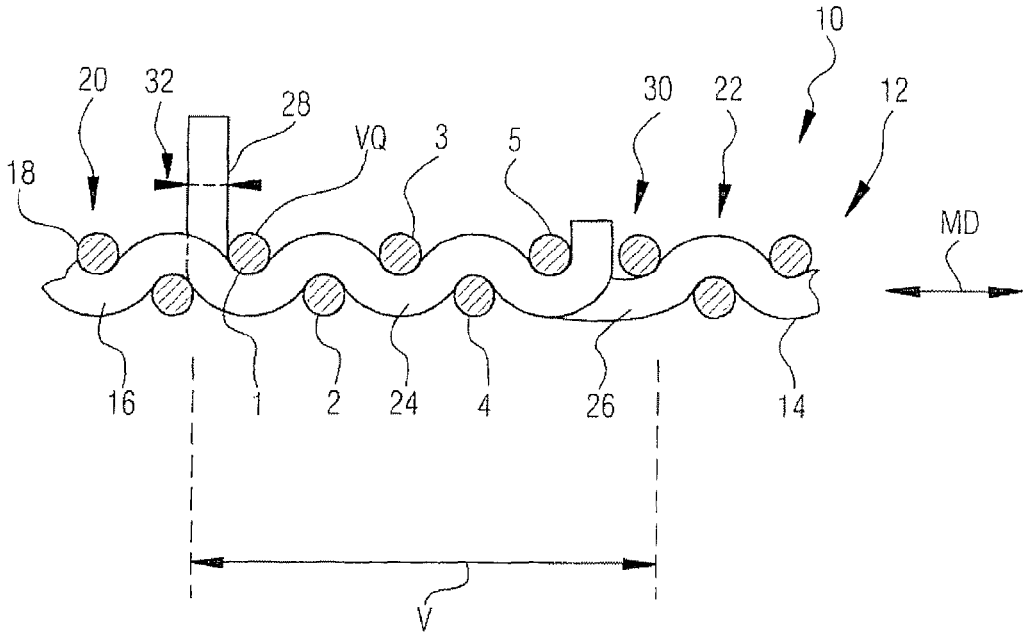
FIG. 1 shows a partial longitudinal sectional view in a connecting zone of a band for a machine for producing web material.

Referring now to the drawings, and more particularly to FIG. 1, there is shown a band 10 for a machine for producing web material. This band, which for example can be used in a press section or a drying section, includes a band body 12 which, in the example illustrated, is constructed with a fabric layer 14. This fabric layer 14 includes longitudinal filaments 16 running in a band longitudinal direction and transverse filaments 18 running transversely with respect thereto, which is to say substantially in a band transverse direction. During production of this band body, the longitudinal filaments 16 can advantageously be warp filaments, while the transverse filaments 18 are weft filaments. In this way, given a predefined width of such a band 10, it becomes possible to weave the latter with virtually any desired length.

In order to be able to provide the band 10 in an endless configuration, the band body 12 is woven during the weaving operation in such a way that, in both its end regions 20, 22, the longitudinal filaments 16, which is to say for example warp filaments, are provided with end regions 24 and 26 which project, which is to say they are not woven with transverse filaments 18, for example weft filaments. It is to be assumed here, for example, that the two end regions 24 and 26 that can be seen at the ends 20, 22 of the band body 12 are respective end regions of the same longitudinal filaments 16, which of course does not necessarily have to be the case. These end regions 24, 26 of the or all longitudinal filaments 16 are then woven with transverse connecting filaments VQ in order to produce a connecting zone V. In the example illustrated, the connecting zone V includes the transverse connecting filaments 1, 2, 3, 4 and 5. In the connecting zone V, therefore, by way of the end regions 24 and 26 of the longitudinal filaments 16 and the transverse connecting filaments VQ, a woven structure is obtained which can correspond to the woven structure which is present in the remaining band body 12, so that there are uniform surface properties over the entire length of the band 10 now provided in an endless configuration.

It can be seen in FIG. 1 that, during the production of the connecting zone V, filament ends 28 and 30 of the longitudinal filaments 16 or the end regions 24, 26 of the same project beyond the surface of the single fabric layer 14 of the endless band 10. In order in principle to avoid marking effects in the web material to be produced or to be transported, provision can be made for these filament ends 28 and 30 to protrude on that side of the band 10 which does not come into contact with the web material. Likewise, it has been shown that, primarily in the thermally more highly loaded edge regions of such a transport band, there is the risk that the filament ends 28, 30 will slip out of the filament interspaces formed by longitudinal and transverse filaments surrounding said filament ends in the course of the operating lifetime and thus lead to a frayed appearance.

Figure 2:
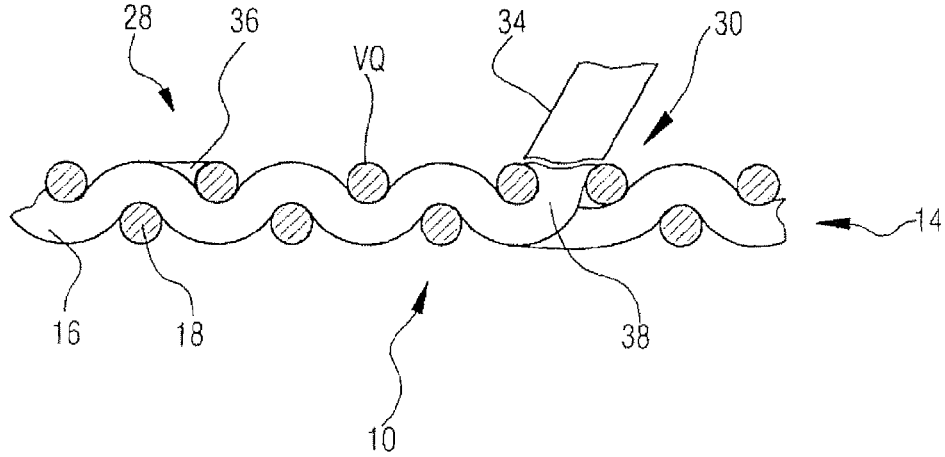
FIG. 2 shows the part of the band illustrated in FIG. 1 after the production of cross-sectional widenings at filament ends.

In order to counter this problem, in the band 10 according to the invention, cross-sectional widenings are formed in the region of these filament ends 28 and 30 in a manner described below. In this case, firstly after the production of the connecting zone V, by way of the use of cutting tools 32 which can be seen at the filament ends 28 in FIG. 1, care is taken that, as can already be seen by using the filament end 30, these protrude beyond the fabric layer 14 with only a predetermined dimension. This predetermined dimension can lie in the range from 3 to 5 mm, of course also dependent on the thickness of the longitudinal filaments 16. After the filament ends 28 and 30 have been shortened to this predetermined length or have already been provided with such a length during the connecting operation, at least in those regions in which cross-sectional widenings are to be formed, which is to say for example the edge region of such a band 10, the cross-sectional widenings are then provided at these filament ends 28 and 30. When longitudinal filaments 16 with a thermoplastic constructional material are used, for example polyethylene, this can be done by action being taken on the filament ends 28 and 30 by way of a tool 34 indicated in FIG. 2, for example the tip of a soldering iron. Thus, by way of pressing on these filament ends 28, 30, it can be ensured that these are flattened and widened, so that the cross-sectional widenings 36, 38 that can be seen in FIG. 2 are formed. Since, in the region of the filament ends 28, 30, the longitudinal filaments 16 are in each case surrounded directly by other longitudinal filaments or transverse filaments, given an appropriate pressure loading by way of the tool 34, the cross-sectional widenings 36, 38 will be formed in such a way that they match the shape of the surrounding filaments. This means that the cross-sectional widenings will have a dimension which is larger than a respective fabric interspace in which a longitudinal filament 16 having such a cross-sectional widening 36 or 38 extends between the further longitudinal filaments 16 and transverse filaments 18 surrounding it. In this way, it is possible to ensure reliably that filament ends 28 and 30 treated in this way can no longer slip out of the fabric structure. Furthermore, in this way it is possible to ensure that the filament ends 28, 30 no longer protrude above the surface of the band 10, so that, even when the side of the fabric layer 14 on which these cross-sectional widenings 36, 38 are present is in contact with rolls carrying such a band or driving it forward, disadvantageous interactions, which for example could lead to unstable running, are avoided.

As already explained above, it is of course possible to restrict a treatment of this type to those regions of the connecting zone V in which the risk of the band ends slipping out is particularly great, which is to say for example the edge regions. In the region located in between, which also comes into contact with the web material to be produced, it is for example possible to dispense with this treatment. There, for example, the band ends 28 and 30 can be shortened still further, since no material has to be maintained in order to produce cross-sectional widenings. Furthermore, it should be pointed out that, during the thermal treatment described above, the cross-sectional widening does not necessarily have to be produced by pressing a hot tool onto a respective band end. Even slight contact and corresponding heating of such a filament end can result in the latter retreating, forming a ball-like cross-sectional widening, so that this ball-like cross-sectional widening is located substantially completely within the thickness of the single fabric layer 14.

In an alternative type of configuration, it is also possible for cross-sectional widenings of this type not to be produced by thermal treatment but by knotting them, that is to say the formation of knots at the filament ends. In this case, too, the cross-sectional widenings therefore form an integral constituent part of the longitudinal filaments 16 themselves, since they are also provided from the constructional material of the latter, albeit by mechanical handling.

In a further alternative type of configuration it is possible to fit small clamp-like or staple-like elements at the filament ends, which are clamped firmly to the filament ends 28 and 30 and thus, in the region of these filament ends, are able to ensure a cross-sectional widening and to prevent the filament ends slipping out of the fabric interspaces. It is obvious that various types of cross-sectional widenings can also be produced over the width of such a band 10. Furthermore, it should be pointed out that cross-sectional widenings of this type can of course also be provided when such a band is constructed with more than one fabric layer, which is to say for example a fabric layer on the side of the web material and a fabric layer on the side of the machine are provided, which are joined to each other by separate binding filaments or possibly also structure-forming binding filaments.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A band for a machine for producing a web of fibrous material, said band comprising:

at least one fabric layer including a plurality of longitudinal filaments running substantially in a band longitudinal direction, a plurality of transverse filaments running substantially in a band transverse direction, and a plurality of transverse connecting filaments, said plurality of longitudinal filaments including a plurality of end regions and a plurality of filament ends, said plurality of end regions of said plurality of longitudinal filaments being woven with said plurality of transverse connecting filaments in order to provide an endless configuration of the band, said plurality of filament ends being respectively a plurality of terminating ends, said plurality of terminating ends of at least some of said plurality of longitudinal filaments woven with said plurality of transverse connecting filaments including a plurality of cross-sectional widenings and individually forming respectively said plurality of cross-sectional widenings, said plurality of filament ends including a plurality of knots which form at least some of said plurality of cross-sectional widenings.

2. The band according to claim 1, wherein said plurality of cross-sectional widenings form an integral constituent part of said plurality of longitudinal filaments.

3. The band according to claim 1, wherein said plurality of filament ends include deformed ones of said plurality of filament ends, said deformed ones of said plurality of filament ends forming at least some of said plurality of cross-sectional widenings.

4. The band according to claim 3, wherein at least some of said plurality of longitudinal filaments with said plurality of cross-sectional widenings include a thermoplastic material, said at least some of said plurality of cross-sectional widenings formed by said deformed ones of said plurality of filament ends being formed by hot deformation.

5. The band according to claim 1, further comprising a plurality of edge regions, said plurality of longitudinal filaments including said plurality of cross-sectional widenings substantially only in said plurality of edge regions of the band.

6. The band according to claim 1, wherein said at least one fabric layer includes a plurality of interspaces, said plurality of cross-sectional widenings at said plurality of filament ends being dimensioned in such a way that said plurality of cross-sectional widenings are respectively larger than said plurality of fabric interspaces one of in or near said plurality of filament ends with said plurality of cross-sectional widenings by said plurality of longitudinal filaments and said plurality of transverse filaments surrounding said plurality of filament ends.

7. The band according to claim 1, wherein said plurality of longitudinal filaments are a plurality of warp filaments and said plurality of transverse filaments are a plurality of weft filaments.

8. The band according to claim 1, wherein the band is configured for being used in a press section of the machine for producing the web of fibrous material.

9. The band according to claim 1, wherein the band is configured for being used in a drying section of the machine for producing the web of fibrous material.

10. A band for a machine for producing a web of fibrous material, said band comprising:

at least one fabric layer including a plurality of longitudinal filaments running substantially in a band longitudinal direction, a plurality of transverse filaments running substantially in a band transverse direction, and a plurality of transverse connecting filaments, said plurality of longitudinal filaments including a plurality of end regions and a plurality of filament ends, said plurality of end regions of said plurality of longitudinal filaments being woven with said plurality of transverse connecting filaments in order to provide an endless configuration of the band, said plurality of filament ends being respectively a plurality of terminating ends, said plurality of terminating ends of at least some of said plurality of longitudinal filaments woven with said plurality of transverse connecting filaments including a plurality of cross-sectional widenings and individually forming respectively said plurality of cross-sectional widenings, wherein at least some of said plurality of filament ends include a plurality of clamping elements fitted thereto, thereby forming at least some of said plurality of cross-sectional widenings.

11. A process for producing a band for a machine for producing a web of fibrous material, said process comprising the steps of:

producing a band body including at least one fabric layer including a plurality of longitudinal filaments running substantially in a band longitudinal direction and a plurality of transverse filaments running substantially in a band transverse direction such that, at a plurality of band body ends, said plurality of longitudinal filaments project with a plurality of end regions;

weaving said plurality of end regions of said plurality of longitudinal filaments at said plurality of band body ends with a plurality of transverse connecting filaments (VQ) in order to provide an endless configuration of the band; and providing a plurality of cross-sectional widenings at a plurality of filament ends of at least some of said plurality of longitudinal filaments, said plurality of filament ends being respectively a plurality of terminating ends, said plurality of terminating ends individually forming respectively said plurality of cross-sectional widenings, said plurality of filament ends including a plurality of knots which form at least some of said plurality of cross-sectional widenings.

12. The process according to claim 11, further comprising, after said step of weaving has been carried out and before said step of providing step is carried out, the step of shortening said plurality of filament ends of said plurality of longitudinal filaments to a predetermined excess dimension.

* * * * *